US005303448A

United States Patent [19]

Hennessey et al.

[11] Patent Number: 5,303,448

[45] Date of Patent: Apr. 19, 1994

[54] HOPPER AND FILTER CHAMBER FOR DIRECT FORWARD THROW SWEEPER

[75] Inventors: Robert D. Hennessey, Golden Valley; Timothy G. La Rocque, Plymouth, both of Minn.

[73] Assignee: Tennant Company, Minneapolis, Minn.

[21] Appl. No.: 910,634

[22] Filed: Jul. 8, 1992

[51] Int. Cl.[5] ..... E01H 1/08

[52] U.S. Cl. ..... 15/340.3; 15/334; 15/347; 15/349

[58] Field of Search ..... 15/331, 334, 340.3, 15/347, 348, 349; 55/304

[56] References Cited

U.S. PATENT DOCUMENTS

| | | | |
|---|---|---|---|
| 2,375,331 | 5/1945 | Taylor | 15/347 |
| 3,186,021 | 6/1965 | Krier et al. | 55/304 |
| 3,304,572 | 2/1967 | Wendel | 15/340.3 |
| 3,639,940 | 2/1972 | Carlson et al. | 15/349 |
| 3,881,215 | 5/1975 | Krier et al. | 15/347 |
| 4,457,043 | 7/1984 | Oeberg et al. | 15/347 |
| 4,459,719 | 7/1984 | Notestine | 15/349 |
| 4,557,739 | 12/1985 | Fortman et al. | 15/349 |
| 4,819,676 | 4/1989 | Blehert et al. | 15/349 |
| 4,979,260 | 12/1990 | Holsten et al. | 15/349 |

FOREIGN PATENT DOCUMENTS

| | | | |
|---|---|---|---|
| 0654335 | 12/1937 | Fed. Rep. of Germany | 15/340.3 |

*Primary Examiner*—Harvey C. Hornsby
*Assistant Examiner*—James F. Hook
*Attorney, Agent, or Firm*—Kinzer, Plyer, Dorn McEachran & Jambor

[57] ABSTRACT

In a direct forward throw sweeper, improvements related to a door for closing the opening into the hopper permit backing away from a debris receptacle with the hopper door open after dumping a load of debris without damage to the machine. An attachment part is provided for connecting a vacuum pickup wand to the debris hopper. Associated improvements to a related air filter chamber provide improved dust control while dumping the hopper and convenient access for servicing a dust accumulation space in the bottom of the filter chamber.

15 Claims, 4 Drawing Sheets

Fig. 2.
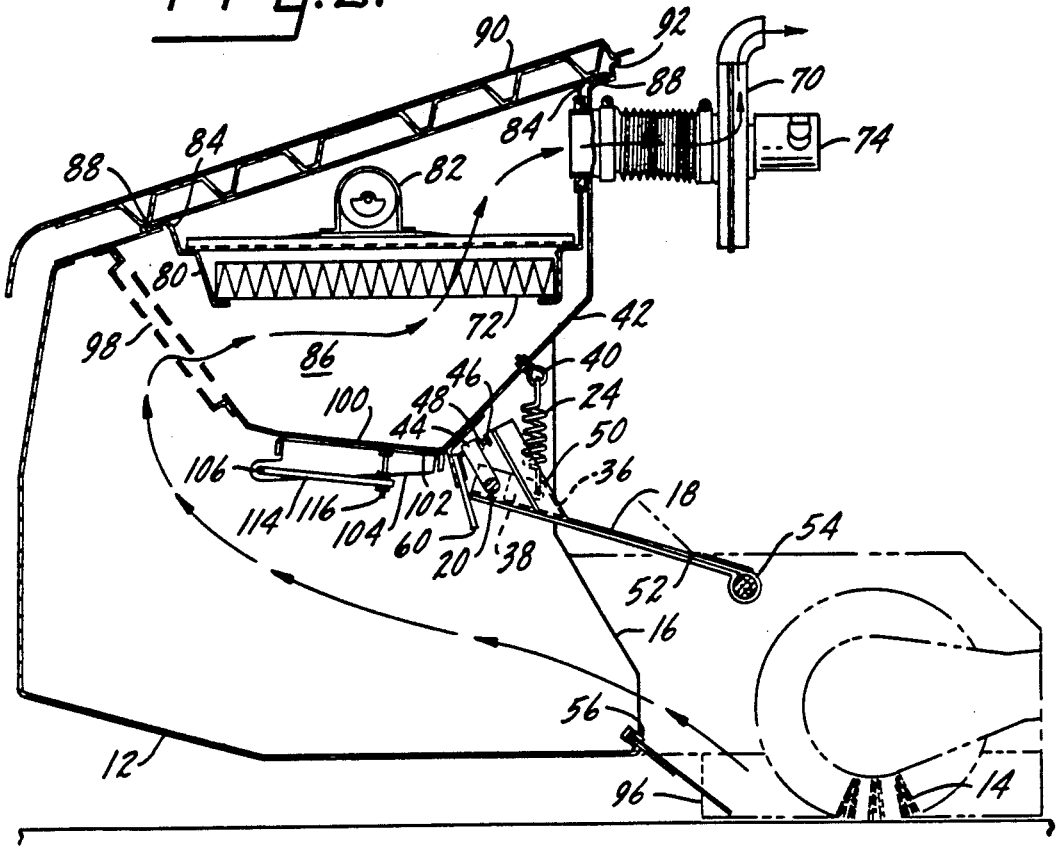
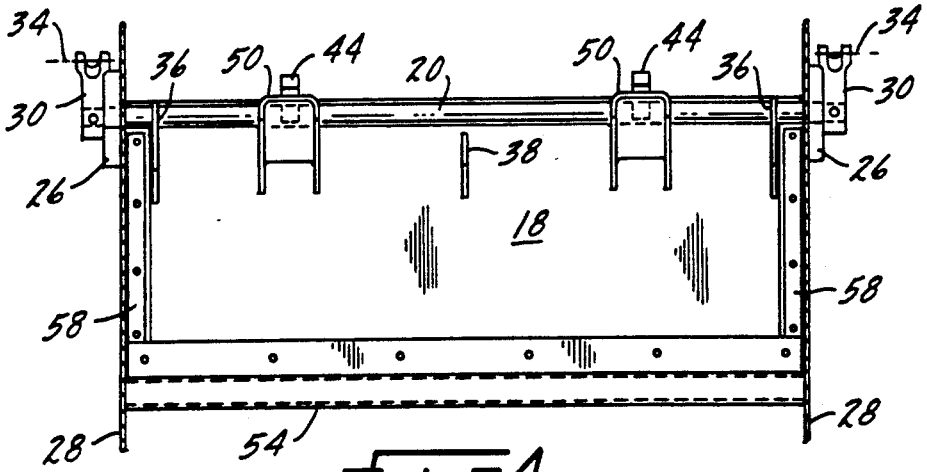
Fig. 4.

94
12
64
62
98
108
110
86
80
106
112
114
32
88
84
116
22
102
100
90
104
34
60
30
20
82
42
16
36
72
24
18
40
84
88
10
92
54
25
70
118
74
14
96

HOPPER AND FILTER CHAMBER FOR DIRECT FORWARD THROW SWEEPER

BACKGROUND OF THE INVENTION

Direct forward throw sweepers are well-known machines for sweeping debris from floors of buildings and also from outdoor areas. Such a sweeper uses a cylindrical brush rotating about a transverse horizontal axis to throw debris from a surface being swept directly into a debris hopper located in front of the brush. The hopper must, of course, have an opening facing the brush to permit entrance of the debris thrown by the brush.

When the sweeper has loaded as much debris as possible into the hopper then it must be emptied, or dumped. This involves raising the hopper a little if the debris is to be "low dumped" in a pile on the floor, or to a substantial height if the debris is to be "high dumped" into a truck body or trash container. Then the hopper is "rolled out" or tilted so the contained debris will slide out. Some sweepers are built to tilt forward and empty through a dump door in the front of the hopper, but a more economical design is to tilt the hopper to the rear and empty it through the opening that admits debris during sweeping, thereby saving the cost of a special dump opening and door. It is with the rear dump design that we are concerned.

High dumping a sweeper with a rear dump hopper involves raising the hopper and tilting it to the rear. Commonly these movements are combined by using a pair of lift arms attached at their forward ends to the sides of the hopper and pivoted at their rear ends on a transverse line at a high point on the sweeper. An actuator such as a hydraulic cylinder pivots the lift arms and attached hopper upwardly about the pivot point, so that in one motion the hopper opening rises to a desired height and also is turned to face downwardly. The machine is then moved forward so that the hopper is over the truck bed or trash container to be emptied into and the debris is dumped.

In order to prevent premature dumping of the debris while the hopper is being raised it is necessary that a door be provided to close the hopper opening until the hopper is in the final position where it is to be dumped. Such a door is commonly hinged across the top of the hopper opening so that it swings down to close the opening and is opened and closed by one or more actuators such as hydraulic cylinders which hold the door firmly in an open or closed position as selected by the machine operator. When the hopper has been tilted into final high dumping position its opening will be facing downward, and when the hopper door is opened it will project down and will be the lowest part of the hopper. As such it may be below the lip of the trash container being dumped into, and since it is positively connected to its actuator the machine is susceptible to damage if the operator backs it away from the container with the door open after dumping. Such misadventures are all too common.

Sweepers of the type being discussed commonly are equipped with a dust control system to prevent dust stirred up by the sweeping brush from escaping into the surrounding atmosphere. Such a dust control system commonly comprises a vacuum fan which pulls air in under the skirts that surround the brush, into the hopper, then through an air filter in a filter chamber adjacent to the hopper which removes entrained dust. Finally the clean air is exhausted to atmosphere.

In the past it has been common to further utilize the vacuum fan by offering a vacuum pickup wand with a flexible suction hose as an accessory for cleaning restricted areas where the sweeper could not enter. A means was provided for closing off the entrance to the air filter chamber, thereby converting it into an airtight plenum, and attaching the suction hose of the wand to a port in a side wall of this plenum, in a location on the so-called "dirty side" of the air filter.

This approach provided a functional vacuum cleaner, but it had a disadvantage in that debris picked up by the wand was fed into the filter chamber. This chamber was only intended to hold the fine dust typically collected by an air filter, and periodically to dump this dust, so a typical filter chamber commonly did not have much capacity or an adequate outlet to satisfactorily dump the sometimes rather coarse debris picked up by the wand. Such debris would on occasion clog the filter chamber and a very awkward service operation was required to clean it out. To date there has been no satisfactory solution to this problem.

Dust control is also a concern when dumping debris from the hopper of a sweeper, as well as when sweeping. The mass of debris being dumped generates an objectionable cloud of dust, which is aggravated in prior art sweepers by a stream of fine dust released from the filter chamber concurrently with the hopper dumping. A solution to this problem is needed, and even partial relief would be appreciated.

Also, it is advisable to thoroughly clean the bottom of the filter chamber periodically, but access to this area has been inconvenient and time consuming, a condition which needed improvement.

SUMMARY OF THE INVENTION

New and useful improvements have been invented for a direct forward throw sweeper having a rear dump hopper. According to the invention an improved door arrangement is provided for opening the hopper entrance opening on occasion, improved means are provided for connecting a vacuum wand to the hopper, and a filter chamber is provided which has improved arrangements for dumping and servicing it. Together these improvements protect the hopper door from inadvertent damage during dumping, provide a better way of applying a vacuum wand to the sweeper, improve control of dust resulting from dumping the filter chamber, and provide easier service access to the bottom of the filter chamber.

When viewed in the normal sweeping position the door for closing the hopper entrance is attached by hinges along its upper edge to the hopper at the upper edge of the entrance opening. One or more tension springs are attached to the door and anchored to the structure of the hopper above the entrance opening so that they pull up on the door and hold it open for normal sweeping and also when debris is being dumped from the hopper. One or more actuators, e.g. hydraulic cylinders, act in opposition to the springs when desired to push the door down and hold it there, thus closing the entrance opening to the hopper. However, when the door is to be opened these actuators retract freely without pulling on the door and have no connection with it; only the springs act to pull the door open and hold it open.

Thus in the situation where the hopper is being high dumped into a trash container or truck body, and the door is projecting down as the lowest part of the hopper, even if the door is lower than the rim of the trash container the sweeper can back away from the container with the door open. The springs will yield, allowing the door to slide up and over the rim of the container without doing any structural damage to the sweeper or the container, thus overcoming a problem found in the prior art.

Another aspect of the invention lies in a port in one side of the hopper for attaching the flexible hose of a vacuum wand, rather than sealing off the filter chamber and porting the wand into that area, as in previous practice. The hopper can be used this way because the improved hopper door has seals around its periphery so it seals the hopper entrance opening in an essentially airtight manner, thereby converting the hopper into an essentially airtight plenum. Porting into this hopper plenum allows debris picked up by the wand to be collected in the hopper along with the general mass of debris thrown in by the sweeping brush. This avoids the prior art problem of the filter chamber becoming clogged with debris sucked up by the vacuum pickup wand.

Directly above the hopper is a chamber which houses an air filter used to clean dust out of the air stream, which moves up through the filter. A conventional vibratory mechanism periodically shakes the dust out of the filter; it drops to the bottom of the filter chamber and collects there. An opening in the bottom wall of the filter chamber below the filter is closed by a hinged door during normal sweeping and the airflow is directed through another entry into the filter chamber. However, when the hopper door is closed a linkage from the actuator which closes it is arranged to open the door closing the filter chamber bottom opening. The fan may be shut off at this time, and the hopper entrance door will be closed, so the dust that has been collected in the bottom of the filter chamber will fall through the bottom opening and settle on the debris pile in the hopper. If the vibratory mechanism used to shake dust out of the filter is actuated at this time it will also vibrate the filter chamber to some degree and may help loosen the dust accumulated in the bottom of the chamber so that more of it will fall through the opening into the hopper below. When the hopper is dumped, this dust from the filter chamber will slide out with the hopper debris, and will not as readily fly into the atmosphere as does the dust stream dumped concurrently from the filter chamber by prior art sweepers.

Periodically it is advisable to thoroughly clean the lower portion of the filter chamber. This area is quite inaccessible in current sweepers, usually being accessed only by unbolting and removing the filter and its shaker mechanism. The current invention simplifies this access problem by mounting the filter and shaker in a supporting structure which drops into place in the filter chamber and is secured when a lid is lowered over it and latched into place. After unlatching and raising the lid and disconnecting two wires leading to the shaker motor, it is possible to lift out the filter, the shaker and the supporting structure as a unit, or they may be tilted up on one edge and propped in place without disconnecting the wires. Either method provides the desired access in a much more convenient way than is found in previous sweepers.

BRIEF DESCRIPTION OF THE DRAWINGS

FIG. 2 is a longitudinal section through the hopper and filter chamber with the parts in normal sweeping position, showing the improved arrangements for filter mounting and filter chamber dumping. It also shows the vacuum fan and airflow through the system in normal sweeping.

FIG. 4 is a view of the hopper door taken on line 4—4 of FIG. 3.

DETAILED DESCRIPTION OF THE INVENTION

Figure 1:
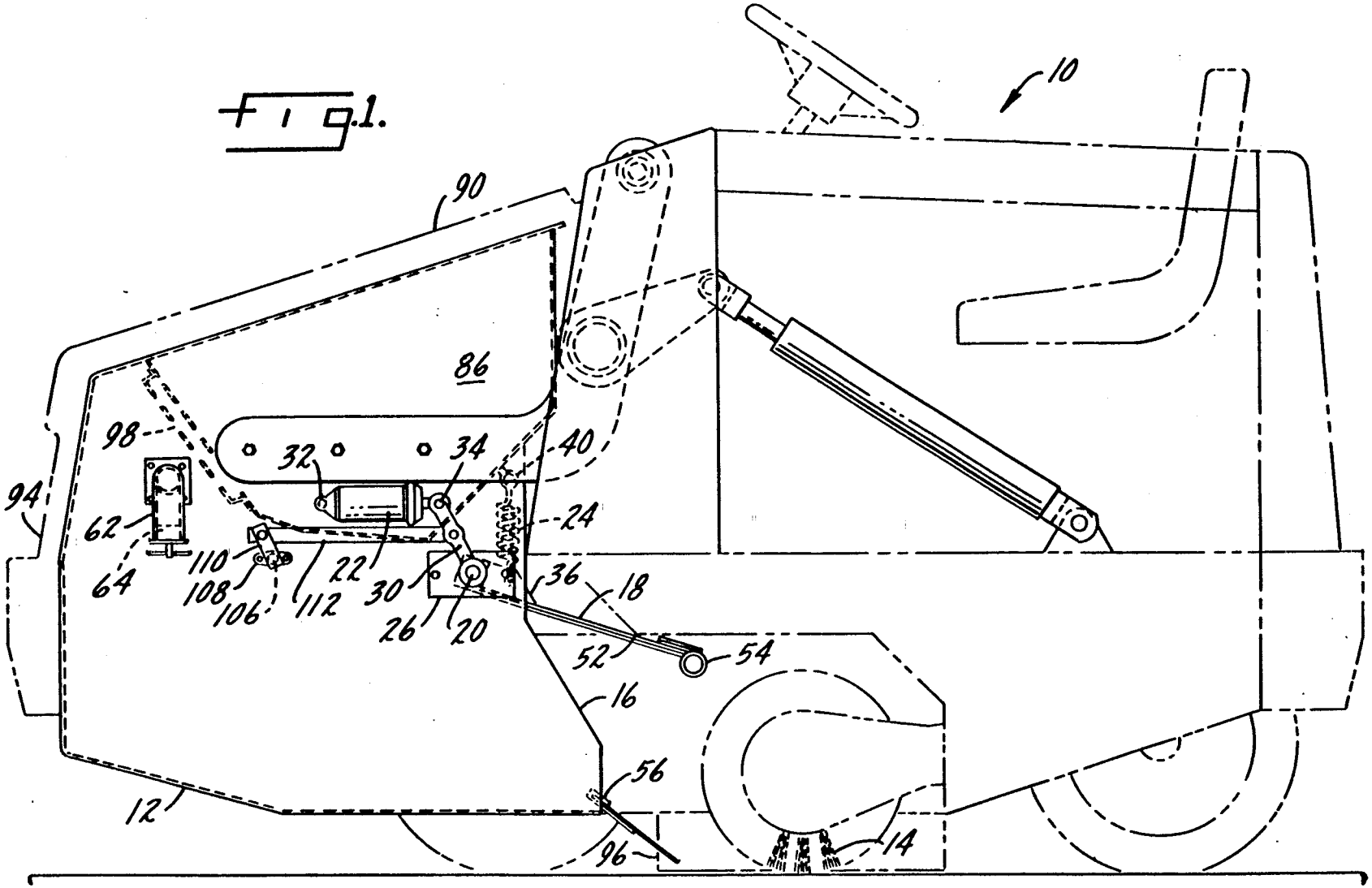
FIG. 1 shows a side view of a direct forward throw sweeper having the improved hopper door of the invention. Irrelevent portions are shown in phantom to emphasize the hopper, hopper lift, hopper door, and the actuator and linkage for operating the hopper door and the filter chamber dump door.

Referring to the drawings, there is shown at 10 in FIG. 1 a direct forward throw sweeper having a debris hopper 12. When sweeping, brush 14 throws debris directly forward into the hopper 12 through an entrance opening 16 in the hopper. Hopper door 18 is hinged about shaft 20 and moves from an open position shown in FIGS. 1, 2 and 5 to a closed position shown in FIG. 3 where it closes the hopper opening 16. Door 18 is closed and held closed by two hydraulic cylinders 22 (only one shown), one on each side of the hopper, while it is opened and held open by three tension coil springs 24 (only one shown).

Shaft 20 passes through aligned holes in the hopper side walls 28 and is journaled in two bearing blocks 26 bolted to the side walls 28. Bushings (not shown) may be provided in the bearing blocks 26. Door 18 is freely hinged around shaft 20 by two hinge plates 36 (FIG. 4) that are welded to the door and have aligned clearance holes through which the shaft 20 passes. Three tension coil springs 24 are hooked to door 18, two being hooked into holes provided in the hinge plates 36 and a third being hooked into a hole in a special spring anchor bracket 38 that is welded to door 18 near its center. The opposite ends of the three springs 24 are hooked to three eye bolts 40 that are bolted to an upper wall 42 of the debris hopper 12. The springs 24 act to hold the hopper door 18 open, so that debris can enter or leave the hopper 12 through the hopper entrance opening 16.

Two actuator arms 30 are pinned to the ends of shaft 20. Hydraulic cylinders 22, which might alternatively be electric actuators or other linear actuators, are pivotally anchored at 32 to lugs welded on the hopper side walls 28, and are pivotally attached at 34 to the actuator arms 30. Two output arms 44 are welded to shaft 20. Each arm 44 has a threaded hole near its outer end, with a bolt 46 threaded into it and locked with a jam nut 48. Welded to door 18 opposite arms 44 are two closing lugs 50.

When hydraulic cylinders 22 are retracted, as shown in FIGS. 1 and 51, output arms 44 will be in the position shown in FIG. 2. Springs 24 will pull door 18 up until it strikes some portion of the sweeper structure as indicated at 52 in FIGS. 1 and 2, or if the door is free of the sweeper structure as in FIG. 5, the springs will pull the door open until the closing lugs 50 strike the bolts 46. The springs 24 will then hold the door 18 open and hopper entrance 16 will be open for debris to enter or leave the hopper 12.

Figure 5:
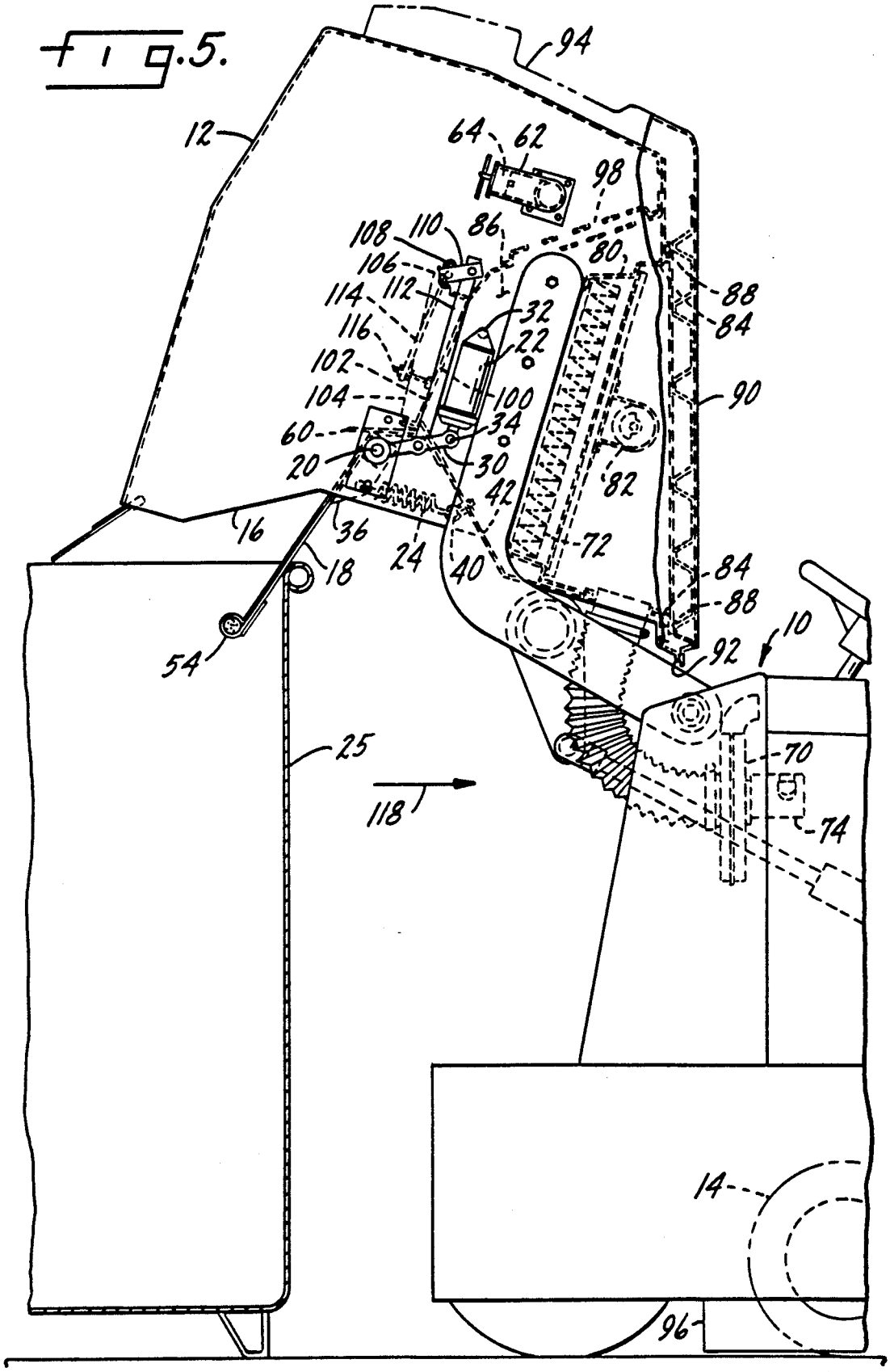
FIG. 5 shows the forward portion of the sweeper, with the hopper in high dump position as it might be when backing up with the hopper dump door open after dumping a load of debris into a trash receptacle.

The advantage of having hopper door 18 opened and held open by springs becomes apparent from FIG. 5. There the sweeper is shown in high dump position, the hopper 12 having just been emptied into a debris container 25. Hopper door 18 is open and is lower than the rim of container 25. The sweeper operator is backing the sweeper away from container 25 in the direction of arrow 118, but has forgotten to first close door 18. If the door 18 was solidly coupled to the hydraulic cylinders 22 as in prior art sweepers there would be a possibility of damage to the sweeper. With the present invention, however, springs 24 will yield, allowing door 18 to slide up and over the rim of container 25 without doing any structural damage to the sweeper or the container.

Figure 3:
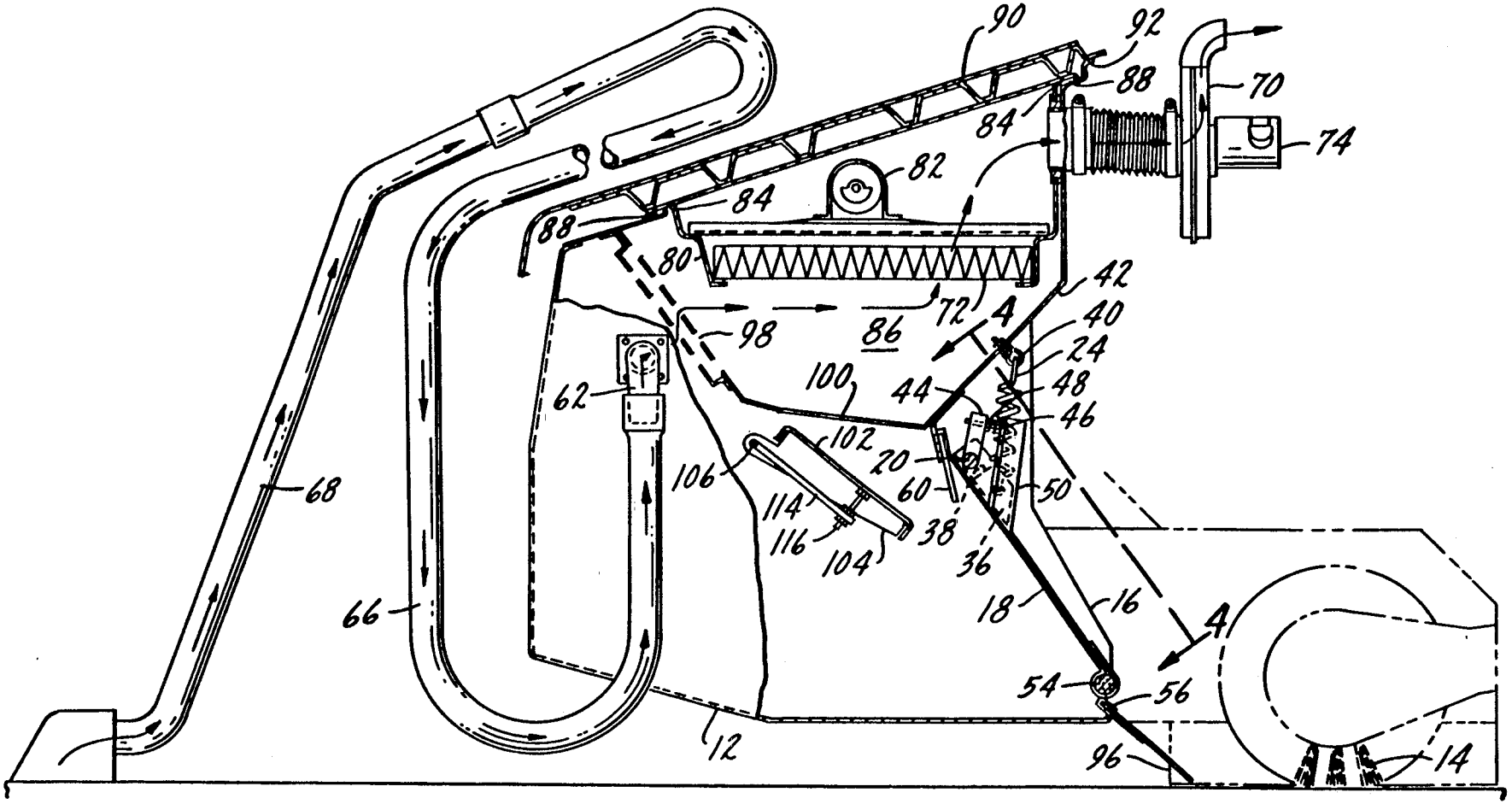
FIG. 3 is a longitudinal section similar to FIG. 2, but the hopper door is shown in closed position, a vacuum wand is shown attached to the hopper, and airflow is shown through the vacuum wand and the rest of the system.

When it is desired to close the hopper entrance 16 the driver of the sweeper may operate a control (not shown) that will cause hydraulic cylinders 22 to extend. Shaft 20 will rotate clockwise as seen in the drawings, and the output arms 44 that are welded to shaft 20 will move to the position shown in FIG. 3. Bolts 46 in the output arms will push on the closing lugs 50 that are welded to the door 18, overcoming springs 24 and moving the door 18 clockwise to where it closes opening 16 as shown in FIG. 3. This closing movement of the door 18 is limited by the stroke built into the hydraulic cylinders 22, and the end position of the closed door 18 may be precisely adjusted by screwing bolts 46 in or out of output arms 44 and then locking them with jam nuts 48.

Door 18 is provided with seals to assure that it will tightly close opening 16. A so-called "bubble seal" 54 extends along the bottom edge of door 18. It is an elastomeric strip extruded with a portion having a hollow circular cross section, which portion is filled with a cylinder of soft foam material. Thus bubble seal 54 is highly compressible, and when the door 18 closes the opening 16 the bubble seal 54 will be compressed against sweeping lip 56 to tightly seal the bottom of the opening 16. As seen in FIG. 4, two side seals 58 are bolted to the sides of door 18 and seal it against the side walls 28 of the hopper 12. Each of side seals 58 is comprised of a strip of elastomeric material retained with a steel strip. Drag seal 60 is also an elastomeric strip, in this case attached to a flange that is welded to an upper wall of the hopper so that the seal 60 rubs against the upper edge of door 18 and seals off any airflow that might pass between the top of the door and the top of opening 16. Thus when door 18 is in position to close opening 16 the hopper 12 becomes essentially an airtight plenum.

As discussed earlier, when the door 18 is closed the hopper 12 may be used as the debris receptacle for a vacuum cleaner attachment which can clean spaces too small for the sweeper to enter. An attachment port 62 is a flanged elbow which is bolted over a hole in one wall of the hopper. When the vacuum cleaner attachment is not in use port 62 may be closed with a stopper 64 as seen in FIGS. 1 and 5. When the vacuum cleaner attachment is to be used, as shown in FIG. 3, stopper 64 is removed, flexible vacuum hose 66 is pushed over the end of the tubular elbow of port 62 and vacuum pickup wand 68 is attached to hose 66. Vacuum fan 70 will pull air through the system as indicated by the arrows in FIG. 3 and exhaust it to atmosphere. Heavy debris picked up by vacuum wand 68 will drop into hopper 12, while fine dust will be removed by filter 72, which may be a conventional flat panel filter. In fact, all the elements of this system are conventional, i.e. the vacuum pickup wand 68, the vacuum hose 66, the filter 72 and the vacuum fan 70. However, the tightly sealed hopper door 18 makes it possible to use the hopper 12 as the debris receptacle for this vacuum cleaner attachment. The hopper provides a large capacity for debris and a convenient means for dumping it, i.e. with the rest of the debris swept into the hopper by the brush 14. This is a distinct advantage over the prior art system of closing off the entrance to the filter chamber and sucking debris into the filter chamber below the filter. That space would not hold as much debris as the hopper and was more difficult to empty. The new arrangement is made possible by the use of tightly sealed door 18 and an adequate vacuum fan 70. To our knowledge nobody has done this before with a sweeper of the type that we are concerned with here.

Another aspect of the invention is concerned with an improved method of handling the fine dust that accumulates in the air filter of one of these sweepers. Every brush-type sweeper stirs up dust, and it is not acceptable to let it billow into the surrounding atmosphere. On sweepers such as we are discussing the problem is handled with a vacuumized dust control system. FIG. 2 shows a schematic representation of such a dust control system.

There is an exhaust fan 70. As shown it is driven by a hydraulic motor 74, but it could be driven by other means, e.g. an electric motor or a belt drive from an engine. It draws in air from within the sweeper and exhausts it to atmosphere. This creates a sub-atmospheric air pressure within the sweeper which causes an air flow as shown by the arrows in FIG. 2. Ambient air pressure pushes air in under the skirts 96 that surround the sweeping brush 14. This inflow of clean air prevents any outflow of dusty air. The air then moves into the hopper 12, carrying with it any dust stirred up by brush 14. The dusty air moves across the hopper 12 and enters the lower part of filter chamber 86, which entrance may include a series of staggered slots 98 that may be made according to U.S. Pat. No. 4,557,739. It has been found that such slots will cause a substantial portion of the dust in the air to drop out of the airstream and fall back into the hopper. The balance of entrained dust will be drawn into the air filter 72, which will stop almost all of it. The air passing through the filter will be clean enough to be exhausted to atmosphere by vacuum fan 70.

The dust that is stopped by filter 72 gradually builds up on the filter and would eventually block it. Therefore it is necessary to periodically clean the filter, which is done by vibrating or shaking it briefly with filter shaker 82. This is a conventional device which may be made according to U.S. Pat. No. 4,258,451. It shakes loose most of the dust on the filter and causes it to drop to the bottom of the filter chamber 86. It accumulates there, and must be periodically removed. Prior art sweepers have been made so that the dust compartment below the filter was emptied at the same time that the main load of debris was emptied from hopper 12. This resulted in a very dusty dumping operation as the free falling filter dust joined the dust kicked up by the load of debris being dumped.

The present invention teaches a less dusty way of emptying accumulated filter dust out of the bottom of the filter chamber. A large opening 100 is provided in the bottom of filter chamber 86. During normal sweeping operation opening 100 is closed by a door 102, to prevent a short circuit of the air stream and assure that it will pass through the staggered slots 98. Door 102 has flanged ends 104 by means of which it is freely hinged to a shaft 106. This shaft passes through two aligned clearance holes in the side walls 28 of the hopper 12 and is journaled in two flanged bearings 108 (only one shown) that are bolted to the hopper side walls 28.

Shaft 106 has two aligned arms 110 (only one shown) pinned to its ends, outside the hopper. Arms 110 are pivotally connected to two links 112 (only one shown) which in turn are pivotally connected to the actuator arms 30. Thus when hydraulic cylinders 22 extend and close hopper door 18, shaft 106 will be rotated clockwise as seen in the drawings.

As best seen in FIGS. 2 and 3, shaft 106 has one or more arms 114 (two aligned arms preferred) welded to it. An adjusting bolt 116 is secured in the end of each arm 114 with two nuts. Bolts 116 bear against door 102. As shown in FIG. 2, dust door 102 is closed when hopper door 18 is open, and as shown in FIG. 3, dust door 102 is open when hopper door 18 is closed. Adjusting bolts 116 may be set to precisely close door 102 when the hydraulic cylinders reach the retracted ends of their strokes.

The effect of this construction is that dust door 102 is closed during normal sweeping, but is opened each time that the hopper door 18 is closed, which is done prior to dumping the hopper. At these times dust which has accumulated in the filter chamber 86 below the filter 72 will drop through the opening 100 and settle on any debris that may be in the hopper. Any free dust caused by this has time to settle before the hopper is actually dumped, at which time the filter dust slides out of the hopper opening 16 along with the debris in the hopper. This new procedure avoids the prior practice of dumping the filter dust freely while the hopper was being dumped, and thereby reduces the free dust stirred up during dumping.

Filter 72 is mounted in a supporting structure 80, which is somewhat like a bowl or deep tray, with an opening in its bottom almost as large as the filter. Filter shaker 82 is mounted above the filter 72 and is also attached to structure 80. Structure 80 has a flange 84 which rests on the upper edges of filter chamber 86. An elastomeric gasket or seal 88 is fitted around flange 84 and seals it to filter chamber 86 and also to a cover assembly 90. This cover assembly has inner ribbed surfaces and an outer smooth surface, and is attached with two hinges 92 (only one shown) to a flanged extension of the right wall of filter chamber 86. It also has a latch (not shown) in the vicinity of 94. By releasing this latch and lifting, cover assembly 90 can be raised much as one would raise the hood of an automobile. It can be held up with a gas spring, prop rod, or other suitable means.

After cover 90 is raised, the filter 72, filter shaker 82 and filter support structure 80 are accessible as an assembly. If the electrical wires leading to filter shaker 82 are disconnected it is possible to lift out the assembly, or tilt it up on one edge and prop it up. Either procedure gives access to the bottom part of the filter chamber 86 for cleaning or other service work. This ease of access to the filter chamber is a significant improvement over prior art sweepers, in which it was necessary to unbolt the filter shaker and the filter to get at the bottom of the filter chamber.

The embodiments of the invention in which an exclusive property or privilege is claimed are defined as follows:

1. In a direct forward throw sweeper having a debris hopper which in normal sweeping position is directly ahead of and adjacent a main sweeping brush, an opening in the hopper which in normal sweeping position is adjacent and faces the brush, said opening being that through which debris is swept directly by the brush into the hopper and emptied out of the hopper, a vacuum fan arranged to pull an air stream from around the brush, into and through the hopper, then through an air filter in an air filter chamber above the hopper in normal sweeping position, and then to exhaust said air stream to atmosphere, said air filter chamber having space below the filter in normal sweeping position for the accumulation of dust removed from the air stream, the hopper having at least one lift arm connected thereto and at least one powered actuator connected to the lift arm, the lift arm and actuator being operable to raise the hopper to a selected elevated height, a door hinged to the hopper adjacent the brush and located to close the aforesaid opening, said door being hinged proximate the edge of the opening which is the upper edge when the hopper is in the normal sweeping position, characterized by resilient means for opening said door and at least one powered actuator acting in opposition to the resilient means for closing the door.

2. The direct forward throw sweeper of claim 1 in which seals are provided between the door and the opening whereby when the door is placed in a position which closes the opening that closure will be effectively airtight, and a selectively open port in a wall of the hopper to accomodate a vacuum pickup wand, said vacuum pickup wand discharging air and debris directly into the hopper through said port.

3. The direct forward throw sweeper of claim 1 in which the air filter chamber is above the hopper in normal sweeping position and is provided with a dump opening in its wall which is its lower wall in normal sweeping position through which dump opening dust that has accumulated in the chamber may be dumped into the hopper, said dump opening in the filter chamber being closed during normal sweeping operation by a closure device, said closure device being coupled to the at least one actuator which closes the hopper door in such a manner that when said actuator closes the hopper door the said closure device will open the dump opening in the filter chamber, and when said actuator is inoperative to close the hopper door, said actuator will be operative to cause the closure device to close the dump opening in the filter chamber.

4. The direct forward throw sweeper of claim 3 in which the air filter is mounted in a removable supporting structure, an access opening above said air filter and removable supporting structure, and a cover for said access opening, said cover holding said filter and removable supporting structure in said air filter chamber.

5. In a direct forward throw sweeper having a main sweeping brush, a debris hopper which in normal sweeping position is directly ahead of and adjacent said brush, an opening into said debris hopper facing and adjacent said brush for receiving debris directly from said brush and for emptying debris from said hopper when said hopper is in a dumping position; means for moving said hopper from a debris receiving position to a dumping position, a vacuum fan, a filter chamber, an air filter in said filter chamber, said vacuum fan being positioned to pull air from around said brush, through the debris hopper opening, into and through the hopper, into said filter chamber and through said filter, a door pivotally mounted on said hopper adjacent said brush for closing said debris hopper opening to prevent debris from said brush from passing into said hopper, spring means normally biasing said door to an open position, and powered actuator means for moving said door against said spring means to a closed position.

6. The sweeper of claim 5 further characterized by and including a seal between said door and debris hopper for forming an airtight seal thereat.

7. The sweeper of claim 5 further characterized in that said air filter is positioned above said debris hopper, and an opening in said hopper beneath said air filter for dumping dust from said filter into said hopper, and a closure for said opening.

8. The sweeper of claim 7 further characterized in that the powered actuator means for moving said hopper door controls movement of said air filter opening closure.

9. The sweeper of claim 7 further characterized in that said powered actuator means opens said air filter opening closure as it closes said hopper door.

10. The sweeper of claim 7 further characterized by and including means for shaking said air filter to loosen the dust thereon for deposit through said opening into said hopper.

11. The sweeper of claim 6 further characterized by and including a vacuum pickup wand, a port opening in said hopper, said vacuum pickup wand being connected to said port opening to discharge directly into said hopper.

12. The sweeper of claim 11 further characterized in that said vacuum fan draws air from said vacuum wand into said hopper and through said air filter.

13. The sweeper of claim 6 further characterized by and including a plurality of baffles in the air path between said debris hopper and air filter.

14. The sweeper of claim 5 further characterized by and including an access opening directly above said air filter for maintenance access thereto.

15. The sweeper of claim 5 further characterized in that said spring means includes a plurality of coil springs attached at one end to said door and at the opposite end to the hopper.

* * * * *